US006616585B2

(12) United States Patent
Okamoto

(10) Patent No.: US 6,616,585 B2
(45) Date of Patent: Sep. 9, 2003

(54) METHOD AND DEVICE FOR ASSEMBLING PAPER BOX

(75) Inventor: Haruo Okamoto, Oita (JP)

(73) Assignees: Chuestu Tech Co., Ltd., Tokyo (JP); Ryoichi-Hashitani, Kyoto (JP); Takeshi Okamoto, Osaka (JP)

( * ) Notice: Subject to any disclaimer, the term of this patent is extended or adjusted under 35 U.S.C. 154(b) by 0 days.

(21) Appl. No.: 10/149,436

(22) PCT Filed: Dec. 19, 2000

(86) PCT No.: PCT/JP00/08972

§ 371 (c)(1),
(2), (4) Date: Jun. 24, 2002

(87) PCT Pub. No.: WO01/45925

PCT Pub. Date: Jun. 28, 2001

(65) Prior Publication Data

US 2002/0193219 A1 Dec. 19, 2002

(30) Foreign Application Priority Data

Dec. 22, 1999 (JP) ..... 11/364892

(51) Int. Cl.[7] ..... B31B 1/04; B31B 1/26

(52) U.S. Cl. ..... 493/51; 493/68; 493/71; 493/125; 493/127; 493/151; 493/162; 493/183

(58) Field of Search ..... 493/51, 68, 69–72, 493/79–81, 125, 127, 128, 130, 151, 162, 180, 181, 183

(56) References Cited

U.S. PATENT DOCUMENTS 3,512,459 A * 5/1970 Di Frank ..... 493/124
4,006,670 A * 2/1977 Royal ..... 493/10
4,287,704 A * 9/1981 Meyers et al. ..... 53/564
4,341,055 A * 7/1982 Williams et al. ..... 53/462
4,650,450 A * 3/1987 Aiuola et al. ..... 493/179
5,024,641 A * 6/1991 Boisseau ..... 493/171
5,480,371 A * 1/1996 Morita et al. ..... 493/117
5,782,732 A * 7/1998 Herrin ..... 493/131
5,827,162 A * 10/1998 Rubin et al. ..... 493/178
5,916,079 A * 6/1999 Haring et al. ..... 493/125
5,971,906 A * 10/1999 Tharpe et al. ..... 493/131
6,322,486 B1 * 11/2001 Waechter ..... 493/70
6,537,187 B1 * 3/2003 Gamberini ..... 493/162

* cited by examiner

*Primary Examiner*—Rinaldi I. Rada
*Assistant Examiner*—Hemant M. Desai
(74) *Attorney, Agent, or Firm*—Armstrong, Westerman & Hattori, LLP

(57) ABSTRACT

A method of assembling a paper box, comprising a 1st step of carrying a paper box (10*a*) with unfolded both side wall members (26) and (27) into a clearance between a fixed stand (101) and a guide member (100) in the condition that the positions of folded parts (22) and (23) aligned with the positions of both outer end parts of the guide member (100) at a folding station (47) where the guide member (100) is disposed with a slight clearance provided above the fixed stand (101) and a clearance at both end parts thereof set equal to a clearance at the folded parts (22) and (23), a 2nd step of driving a folding member (105) so as to fold both side wall members (26) and (27) to the inside with reference to the outer end part of the guide member (100) in contact with the folded parts (22) and (23), and a 3rd step of extracting the paper box (10*a*) with bent both side wall members (26) and (27) from the folding station (47) by holding the front side of the paper box (10*a*) in its moving direction.

7 Claims, 14 Drawing Sheets

METHOD AND DEVICE FOR ASSEMBLING PAPER BOX

TECHNICAL FIELD

This invention relates to a method and device for assembling a paper box by automatically folding an unfolded box paper along predetermined fold lines, and more specifically to a paper box assembling method and device applicable to making of a box body (lower box) and a lid box (upper box) for covering the box body, which can be transported and stored in its flat folded state and easily assembled fully in use with a simple operation.

BACKGROUND ART

The applicant has disclosed, in Japanese Unexamined Patent Publication No. HEI 9-219960(A1), a pullout-type paper box made of cardboard and comprising a square box bottom part having four sides, outer wall parts respectively connected to the sides of the box bottom part through double fold lines, inner wall parts respectively connected to the outer sides of the outer wall parts through double fold lines, and box-bottom abutting parts respectively connected to the outer sides of the inner wall parts through fold lines. That is, the disclosed paper-made box has double side walls formed of the outer wall parts and inner wall parts.

The aforenoted paper box made of cardboard having relative thick is formed in the flat state at a paper box factory and easily assembled in use. After assembled, the paper box can be returned to its flatly unfolded original state as occasion arises.

On the other hand, an ordinary paper box having fold-line parts opposite to each other in parallel on both sides has been assembled and subjected to usage in the customary way.

In most cases, the aforementioned pullout-type paper box has so far been assembled manually or marketed in its foldaway state. Thus, one worker can produce only 300 to 400 paper boxes of this type per day, and therefore, could not supply growing demand for paper boxes.

Furthermore, the conventional method for assembling the paper box was practiced manually, but the conventional assembling work consumes much time.

The present invention was made in the light of the aforenoted circumstances and has an object to provide a method and device for assembling a paper box capable of being produced on a large scale by automating the assembling of an ordinary paper box and pullout paper box and transported compact in its flatly folded state.

DESCRIPTION OF THE INVENTION

To attain the object described above according to the present invention there is provided a method for assembling a paper box having both side wall members unfolded and connected to a box bottom panel through a pair of parallel fold lines, which comprises a first process of carrying the aforesaid paper box having the aforesaid both side wall members unfolded at a folding station at which long guide members each being longer than the longitudinal length of the aforesaid paper box into spaces between the aforesaid fold lines and the aforesaid guide members with a minute clearance each formed on fixed stands and having both outer end portions between which a distance substantially equal to a distance between the aforesaid both side wall members is defined, so as to coincide the aforesaid fold lines with the both outer end portions of the aforesaid guide members in position, a second process of folding inward the aforesaid both side wall member on the basis of the outer end portions of the aforesaid guide members in contact with the aforesaid fold lines by operating interfolding means disposed on both sides of the aforesaid fixed stands, and a third process of pulling out the aforesaid paper box having the both side wall members folded from the aforementioned folding station while gripping the front side in relation to the forwarding direction of the aforesaid paper box.

The interfolding termed herein implies not only steadying of fold lines by folding, but also making of fold lines. The both side wall members mean portions on the outside of the parallel fold lines of the paper box.

The formation of the paper box as described above enables the fold lines to be steadily folded and a large number of paper boxes to be manufactured in a short period of time.

Besides, since the guide members are left secured in use, moving elements can be reduced in number, thus to decrease mechanical failure rate in operation.

On the upstream side of the folding station, there may be disposed an adhesive applying station to previously apply adhesive to prescribed inner portions of the both side wall members of the aforesaid paper box. By applying adhesive before interfolding the paper box, the folded parts can be maintained firmly and easily.

A paper box assembling device in a first embodiment according to the present invention for assembling a paper box having both side wall members unfolded and connected to a box bottom panel through parallel fold lines, comprises a folding station with fixed stands for placing the unfolded paper box thereon and a pair of guide members each being longer than the longitudinal length of the aforesaid paper box, which guide member is supported at the rear side in relation to the forwarding direction of the aforesaid paper box with a minute clearance formed on the fixed stands, which clearance has both outer end portions between which a distance substantially equal to a distance between the fold lines, and an interfolding mechanism including interfolding means disposed on both sides for folding inward the both side wall members of the aforesaid paper box placed on the aforesaid fixed stands, and a driving source for driving the interfolding means.

With the structure described above, the unfolded paper box can be steadily folded along the fold lines with securing the guide members.

The aforesaid interfolding mechanism may comprise a flexible sheet having basal portion fixed along the side end portions of the aforesaid fixed plates, an outer guide plate disposed on the intermediate part of the aforesaid flexible sheet and having the front end essentially abutting on the fold lines of the aforesaid paper box at the time of folding the paper box, the interfolding means secured on the front part of the aforesaid flexible sheet so as to cover the aforesaid side wall members at the time of folding, a lifting rod connected to the aforesaid interfolding means through a link member and disposed below the aforesaid fixed stands, and a drive means for driving the aforesaid lifting rod.

By lifting the lifting rod, the link member, interfolding means and outer guide plate are rotated to fold inward the paper box along the fold lines.

Since the flexible sheet is rotated simultaneously, the rotating axis is shifted in accordance with displacement of the fold lines of the paper box to be folded so as not to exert excessive force on the device.

On the front side of the aforesaid interfolding means, there may be provided an elastic plate for pressing the front side of the interfolding means at the time of folding the paper box.

According to the structure described above, the both side end portions of the paper box can be folded up into the inside of the fold line and firmly attached to each other. Moreover, in case of adhering, adhesion strength can be increased.

By adjusting the thickness of the guide member, the aforesaid fold line may be a double fold line. Even when adopting the double fold lines, the paper box can be neatly folded.

A paper box assembling device in a second embodiment according to the present invention for assembling a paper box having front, rear, left and right outer wall members connected to a square box bottom panel through pairs of first and second parallel fold lines, front, rear, left and right inner wall members connected to a square box bottom panel through pairs of third and fourth parallel fold lines, and side-panel connecting members connected to the respective side end portions of the adjoining outer wall members and provided on their intermediate portions with diagonal inward fold lines, which comprises a first folding station for allowing the aforesaid left and right inner wall members to be folded back inwardly along the aforesaid fourth fold line and adhered to the aforesaid left and right outer wall members through a first adhesive layer formed beforehand, a second folding station for allowing the aforesaid left and right outer wall members to be folded back inwardly along the aforesaid second fold line, folded up so as to overlap left and right peripheral edge portions of the aforesaid box bottom panel and allowing the aforesaid side-panel connecting members formed at the four corners thereof to be fold back inwardly along connecting fold lines extending from the aforesaid second fold line and adhered to the left and right peripheral edge portions of the aforesaid front and rear outer wall members corresponding to the aforesaid side-panel connecting members formed at the four corners through a second adhesive layer formed beforehand, a third folding station for allowing the aforesaid front and rear inner wall members to be folded inwardly along the aforesaid third fold line and adhered to the aforesaid front and rear outer wall members through the third adhesive layer formed beforehand, which first to third folding stations are each provided with fixed stands for allowing the aforesaid paper box to be placed thereon and a pair of interfolding mechanisms having interfolding means for folding the aforesaid outer or inner wall members inwardly, which interfolding means is disposed on both sides of the aforesaid fixed stands to fold inward the aforesaid outer wall members or inner wall members of the aforesaid paper box placed on the aforesaid fixed stands, while being in contact with the aforesaid outer wall members or inner wall members, and a driving source for driving the aforesaid interfolding means, which first and third folding stations each have a pair of guide members each being longer than the longitudinal length of the aforesaid paper box, which guide member is supported at the rear side in relation to the forwarding direction of the aforesaid paper box with a minute clearance formed on the fixed stands, which clearance has both outer end portions between which a distance substantially equal to a distance between the fold lines.

The front, rear, left and right are termed herein for the convenience of description for accounting for the paper box assembling device according to the present invention, but the front-to-rear and left-to-right relationships may of course be reversed.

With this mechanism, automation of assembling the paper box can be achieved by use of the multiple folding stations.

The paper box assembling device of the invention may further comprise a first adhesive applying station for forming the aforesaid first and second adhesive layers, which is placed on the upstream side of the aforesaid first folding station, and a second adhesive applying station for forming the aforesaid third adhesive layer, which is placed on the upstream side of the aforesaid third folding station, so that the aforesaid first adhesive layer is formed on a part of the inside of each of the aforesaid left and right outer wall members, the aforesaid second adhesive layers are formed on the forward-facing end portion of the front piece of the side-panel connecting members disposed at the four corners and the backward-facing end portion of the rear piece of the side-panel connecting members, and the third adhesive layer is formed on the outer sides of the front and rear inner wall members or the inner sides of the front and rear inner wall members. The distance between the inner end portions of the left and right outer wall member is substantially equal to the distance between inner side end portions of the left and right side-panel connecting members.

Thus, the first and second adhesive layers can be formed by allowing the paper box to pass a spray nozzle or coating roller for forming the adhesive layer. Since the first and second adhesive applying stations are on the respective upstream sides of the first and third folding stations, applying of the adhesive and folding of the portions applied with the adhesive can be carried out continuously so as to prevent the adhesive power of the adhesive applied to the paper box from being decreased on the way to the folding station.

The first adhesive applying station, first folding station and second folding station may be located on a first transfer conveyor, and the aforesaid second adhesive applying station and third folding station may be located on a second transfer conveyor arranged orthogonal to the first transfer conveyor for turning the aforesaid paper box 90 degrees. With this mechanism, the direction in which the paper box is fed can be changed, so that the direction in which the paper box is folded by the third folding station can be made parallel to that in which the paper box is folded by the first and second folding stations. The processes from applying the adhesive to the paper box to adhere the paper box can be continuously carried out with respect of each of the front-to-rear and left-to-right directions.

BEST MODE FOR CARRYING OUT THE INVENTION (Construction of Pullout Paper Box)

Figure 1:
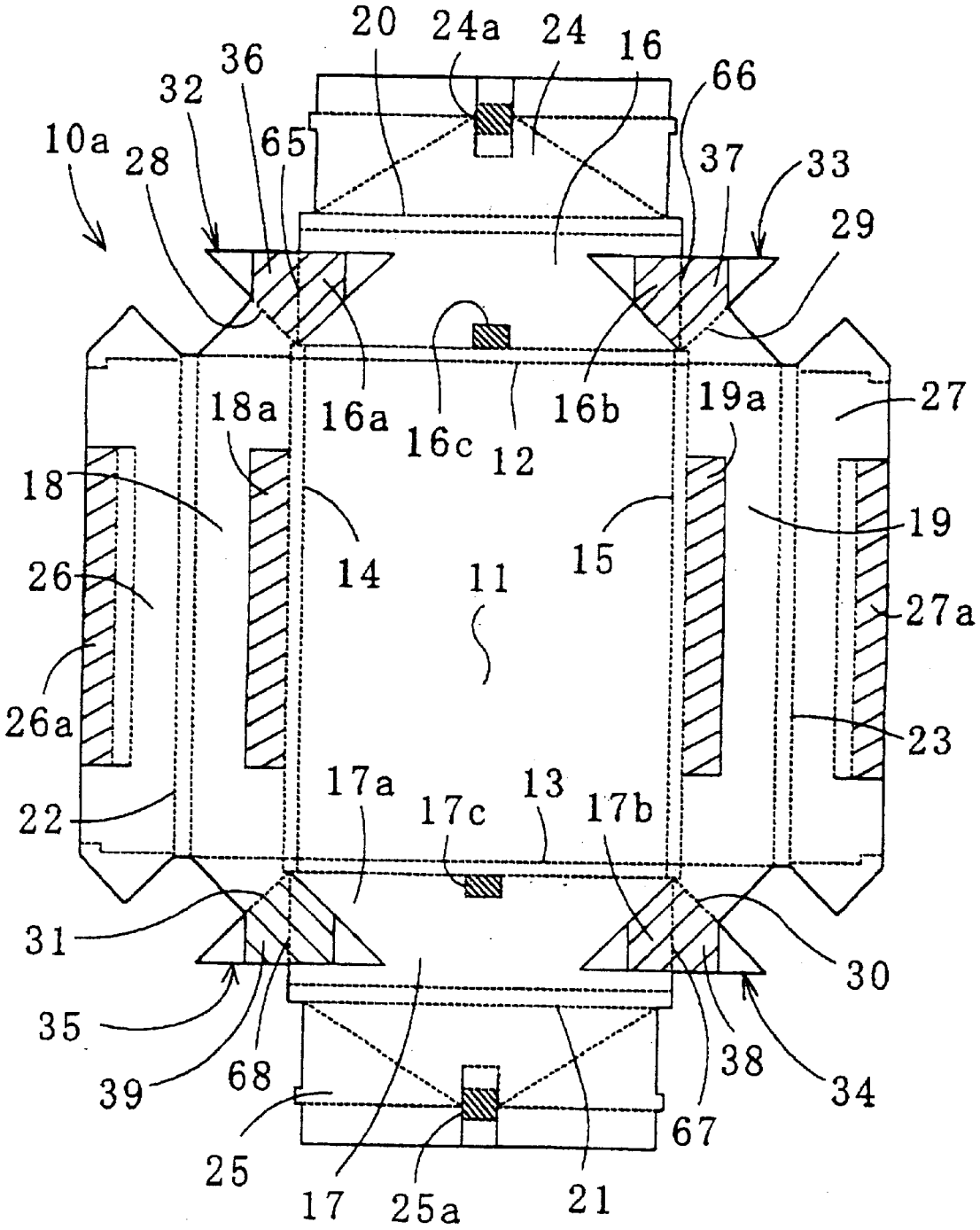
FIG. 1 is a developed view showing a pullout paper box to which one embodiment of an assembling device for producing a paper box according to the present invention is applied.
Figure 2:
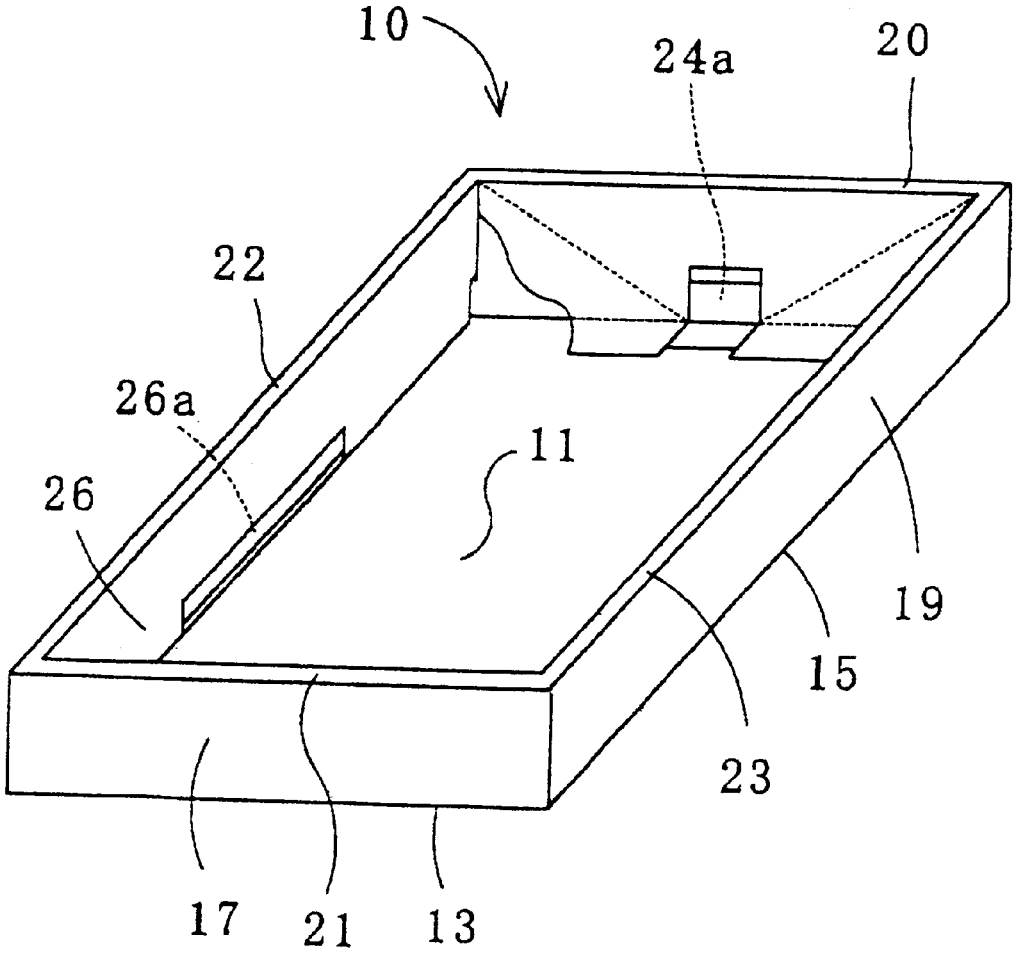
FIG. 2 is a perspective view showing the finished state of the pullout paper box.

First, a pullout paper box 10 as one example of the paper box produced by a paper box assembling device A (shown in FIG. 3 and the subsequent drawings) will be concretely described with referent to FIG. 1 and FIG. 2. In FIG. 1, the pullout paper box 10 is illustrated in its unfolded state, and the paper box 10 in the unfolded state is referred to as a box board 10*a*. FIG. 2 illustrates the assembled state of the pullout paper box 10.

As shown in FIG. 1, the box board 10*a* has a square box bottom panel 11, and front, rear, left and right outer wall members 16–19 connected to the box bottom panel 11 through first parallel fold lines 12 and 13 and second parallel fold lines 14 and 15, which are arranged in pairs on the front, rear, left and right sides thereof, front, rear, left and right inner wall members 24–27 connected to the outer sides of the front, rear, left and right outer wall members 16–19 through third parallel fold lines 20 and 21 and fourth parallel fold lines 22 and 23, which are arranged in pairs on the front, rear, left and right sides thereof, and side-panel connecting members 32–35 having diagonal inward fold lines, which are formed at four corners of the paper box and connected to the adjacent outer wall members 16–19. In this embodiment, the first to fourth fold lines 12–15 and 20–23 are each formed of double fold lines.

On the inner sides of the left and right outer wall members, there are partially formed first adhesive layers 18*a* and 19*a*. Second adhesive layers 36–39 are formed on the forward-facing end portion of the side-panel connecting members 32 and 33 placed on the front side of the side-panel connecting members 32–35 at the four corners. Third adhesive layers 24*a* and 25*a* are formed on the center portions (in part) of the outer sides of the front and rear inner wall members 24 and 25. The first to third adhesive layers 18*a*, 19*a*, 36–39, 24*a* and 25*a* may be formed of hot melt adhesive or the like.

On parts of the outer end portions 26 and 27, into contact with which the first adhesive layers 18*a* and 19*a* come when the left and right inner wall members 26 and 27 are folded back inwardly along the fourth fold lines 22 and 23, there are formed first adhesive surfaces 26*a* and 27*a* sticking to the first adhesive layer 18*a* and 19*a*.

Second adhesive surfaces 16*a*, 16*b*, 17*a* and 17*b* sticking to the second adhesive layers 36–39 are formed on left and right peripheral edge portions of the front and rear outer wall members 16 and 17 which are stuck to the second adhesive layers 36–39 when the side-panel connecting members 32–35 are folded back inwardly along connecting fold lines 65–68 extending from the second fold lines 14 and 15.

Third adhesive surfaces 16*c* and 17*c* sticking to the third adhesive layers 24*a* and 25*a* are formed on the center portions of the inner sides of the front and rear outer wall members 16 and 17 which are stuck to the third adhesive layers 24*a* and 25*a* when the front and rear inner wall members 24 and 25 are folded back inwardly along the third fold lines 20 and 21. The arrangement of the first to third adhesive layers 18*a*, 19*a*, 36–39, 24*a* and 25*a* and the counterpart first to third adhesive surfaces 26*a*, 27*a*, 16*a*, 16*b*, 17*a*, 17*b*, 16*c* and 17*c* may be reversed.

The aforementioned box board 10*a* is temporarily assembled into a flat plate (flat state) so as to be made portable for carrying convenience by using the paper box assembling device A as described below (see FIG. 14). Thereafter, the temporarily assembled box board is delivered to a user and assembled there into a completed pullout paper box 10 shaped in a regular hexahedron as shown in FIG. 2.

(Construction of Paper Box Assembling Device A)

Next, the paper box assembling device A for forming the box board 10*a* shown in FIG. 1 into the primary assembled pullout paper box 10 will be concretely described hereinafter with reference to FIG. 3 through FIG. 13.

Figure 3:
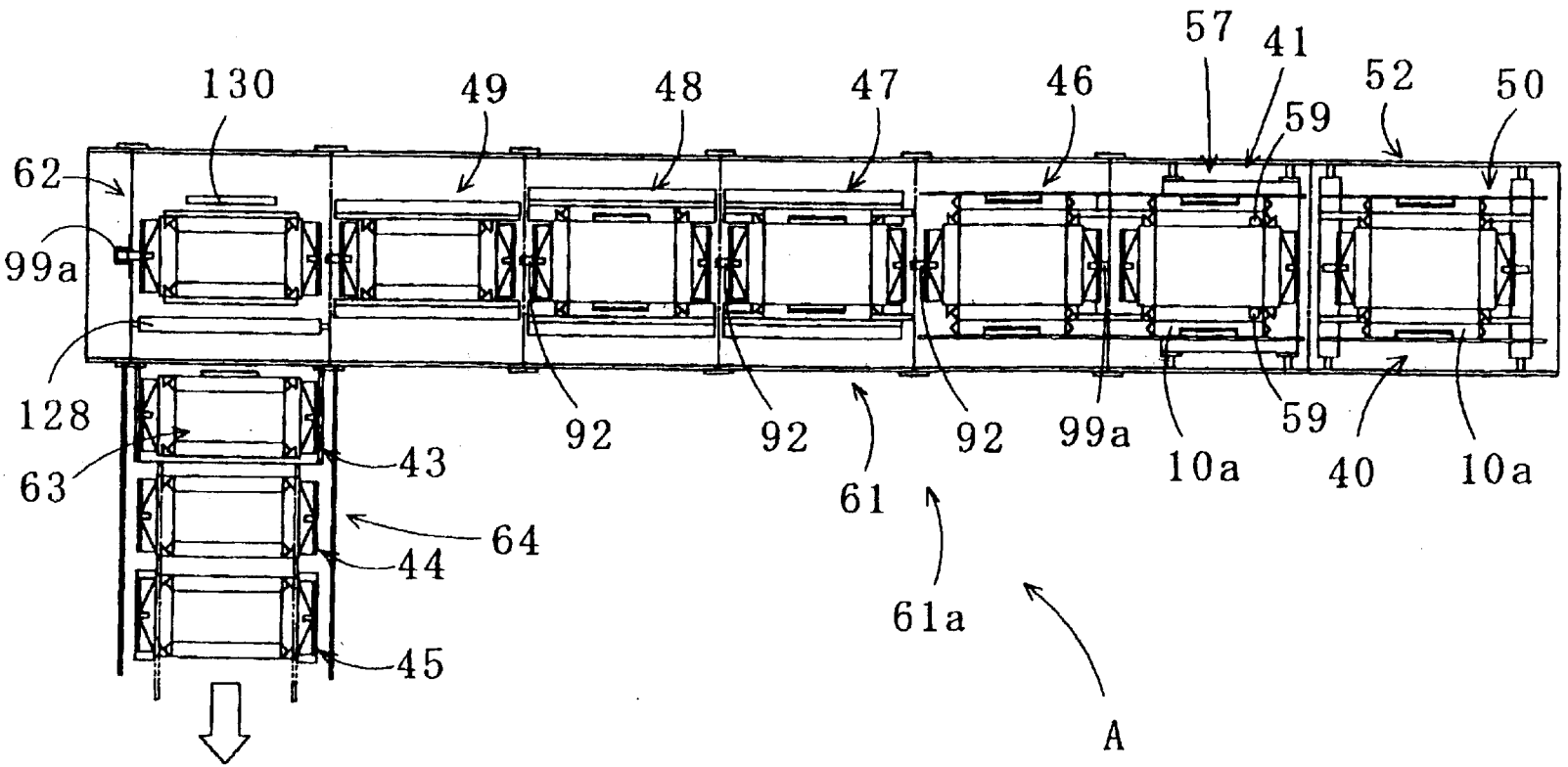
FIG. 3 is a conceptual diagram showing the entire paper box assembling device of the invention.

As shown in FIG. 3, the assembling device A for the pullout paper box comprises first transfer conveyor 61*a* and second transfer conveyor 64 for intermittently feeding the box board 10*a*, and first to third folding stations for folding inwardly the outer wall members 18 and 19 and inner wall members 24–27 of the box board 10*a*, which are formed along the first and second transfer conveyors 61*a* and 64 and provided with fixed stands 101 (see FIG. 7 through FIG. 11) for placing the box board 10*a* thereon.

In addition, the paper box assembling device A further comprises a plurality of processing stations arranged in series for producing the primary assembled pullout paper box 10.

That is, the assembling device A for the pullout paper box includes the first cut-out station 40 disposed on the first transfer conveyor 61*a*, first adhesive applying station 41, first creasing station 46, first folding station 47, second creasing station 48, second folding station 49, second cut-out station 43 disposed on the second transfer conveyor 64 for feeding the box board 10*a* upon turning 90 degrees, second adhesive applying station 44, third folding station 45, and baling station which is not shown in the drawings.

The first cut-out station 40 in the aforementioned device is a station for feeding the box boards 10*a* one by one from a box board stacker 50 for stacking lots of box boards 10*a* toward the first adhesive applying station 41.

The first adhesive applying station 41 is located on the upstream side of the first folding station 47 and serves to form the first and second adhesive layers 18*a*, 19*a* and 36–39 on the box board 10*a* fed from the first cut-out station 40.

The first creasing station 46 serves to preliminarily bend the fourth fold lines 22 and 23 formed between the left and right outer wall members 18 and 19 and the corresponding inner wall members 26 and 27 of the box board 10*a* to form definite fold lines.

The first folding station 47 serves to allow the left and right inner wall members 26 and 27 to be folded back inwardly along the fourth fold lines 22 and 23 and stuck to the left and light outer wall members 18 and 19 through the medium of the first adhesive layers 18*a* and 19*a* formed previously.

The second creasing station 48 service to preliminarily bend the second fold lines 14 and 15 formed between the left and right outer wall members 18 and 19 and the box bottom panel 11 of the box board 10*a* to form pliant parts in the fold lines.

The second folding station 49 serves to allow the left and right outer wall members 18 and 19 of the box board 10*a* to be folded back inward along the second fold lines 14 and 15 and placed on the left and right peripheral edge portions of the box bottom panel, and folding back the side-panel connecting members 32–35 at the four corners inwardly along the connecting fold lines 65–68 to be stuck to the left and right peripheral edge portions facing the side-panel connecting members 32–35 through the medium of the second adhesive layers 36–39 formed previously.

The second cut-out station 43 serves to feed the box boards 10*a* one by one from a storage unit 60 for temporarily storing the box boards 10*a* in piles, which box boards each have the left and right outer wall members 18 and 19 stacked thereto, toward the second adhesive applying station 44.

The second adhesive applying station 44 is located on the upstream side of the third folding station 45 and serves to form the third adhesive layers 24*a* and 25*a* on the box board 10*a* fed from the second cut-out station 43.

The third folding station 45 serves to allow the opposed front and rear inner wall members 24 and 25 to be folded back inwardly along the third fold lines 20 and 21 and stacked to the front and rear outer wall members 16 and 17 through the medium of the third adhesive layer 24*a* and 25*a* formed previously, thus to form the primary assembled pullout paper box 10.

The baling station serves to transfer the primary assembled pullout paper box 10 produced by folding the paper box at the third folding station 45 to a baling machine that is not shown in the drawings.

Next, each of the aforementioned stations will be described in detail with reference to FIG. 3 through FIG. 13.

(First Cut-Out Station)

Figure 4:
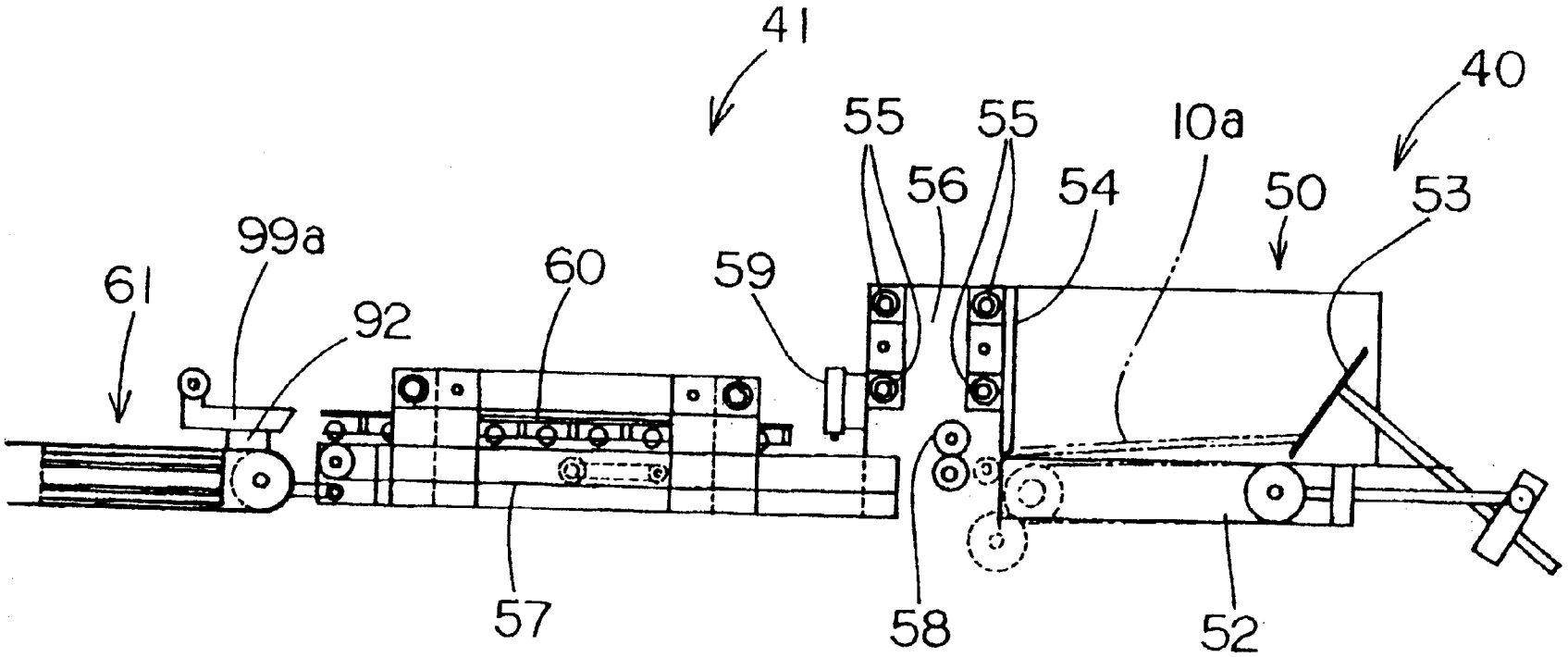
FIG. 4 is a front view showing a cut-out station and adhesive applying station of the paper box assembling device.

As shown in FIG. 4, the first cut-out station 40 is disposed on a cut-out conveyor 52 forming the first transfer conveyor 61*a* and includes the box board stacker 50 formed above the cut-out conveyor. The box board stacker 50 comprises a rear end holding plate 53 arranged aslant so as to raise the rear portion of the box board 10*a* stacked therein, a front end holding plate 54 provided at its lower portion with a slot being open in accordance with the thickness of the box board 10*a* so as to allow the box boards 10*a* to pass therethrough one by one, and a guide plate 56 which is adjustable in width in accordance with the width of the box board 10*a*. By operating the cut-out conveyor 52 in the box board stacker having the aforenoted structure, the box boards 10*a* stacked therein can be sent out one by one from the lower portion of the stacker toward the first adhesive applying station 41.

(First Adhesive Applying Station)

On the downstream side of the first cut-out station 40, the first adhesive applying station 41 is located The first adhesive applying station 41 is disposed on the transfer conveyor (first transfer conveyor) 57 arranged in series with the first cut-out conveyor 52, and includes supply rollers 58 mounted on the upstream end part of the transfer conveyor 57 so as to feed the box board 10*a* in conjunction with rollers mounted on the upstream end part of the transfer conveyor 57, paired spot nozzles 59 for spraying hot melt adhesive, and upper rollers 60 having a plurality of rollers provided in a connected row arrangement so as to press down the box board 10*a*.

The height of the carrying surface of the transfer conveyor 57 formed of a belt conveyor is on the substantially same level with the height of the carrying surface of the cut-out conveyor 52. The spot nozzles 59 are formed in line in the width direction just above the position at which the first adhesive layers 18*a* and 19*a* are formed on the box board 10*a* as shown in FIG. 1, so as to splay the hot melt adhesive in the molten state toward the box board 10*a* at the predetermined intervals. According to this structure, the first adhesive layers 18*a* and 19*a* and the second adhesive layers 36–39 placed on the extension of the first adhesive layers 18*a* and 19*a* can be formed with the single set of spot nozzles 59.

(First Transfer Conveyor)

The first transfer conveyor 61*a* comprises the aforementioned cut-out conveyor 52, the transfer conveyor 57, and the subsequent transfer conveyor (second transfer conveyor) 61.

As shown in FIG. 3 and FIG. 4, the transfer conveyor 61 includes a plurality of gripper 92 spaced in the circumferential direction. With the grippers 92, the front portion of the box board 10*a* fed from the transfer conveyor 57 to the transfer conveyor 61 can be grasped securely.

Figure 5:
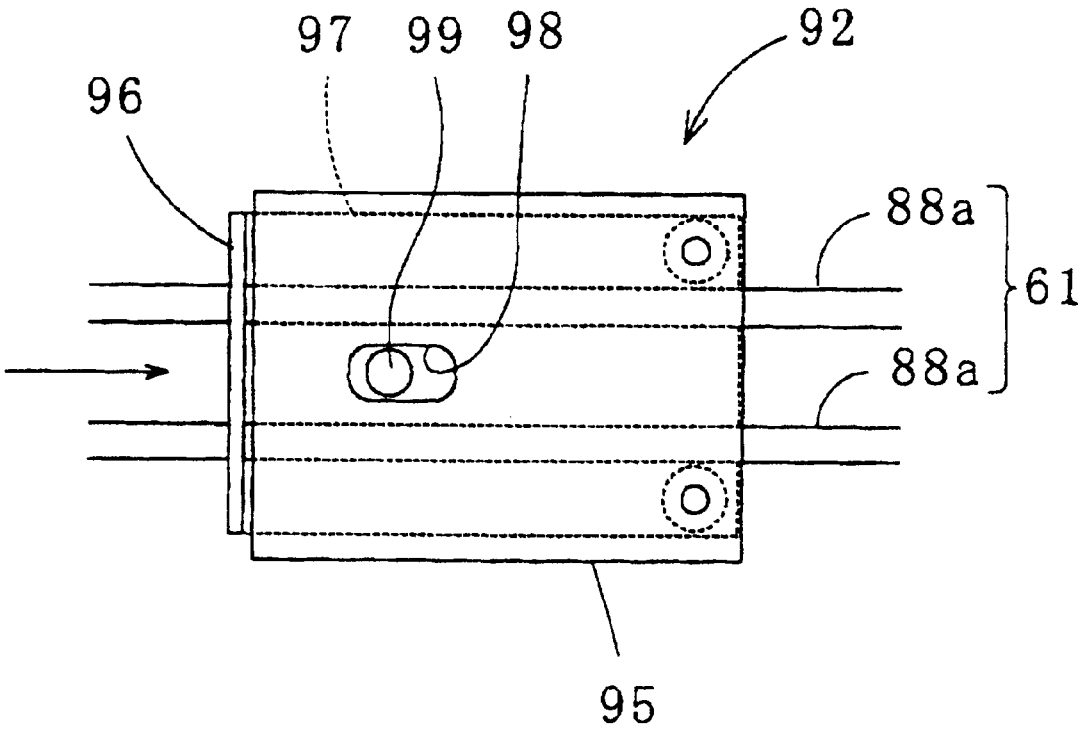
FIG. 5 is a plan view showing a gripper used in a transfer conveyor in the paper box assembling device.
Figure 6:
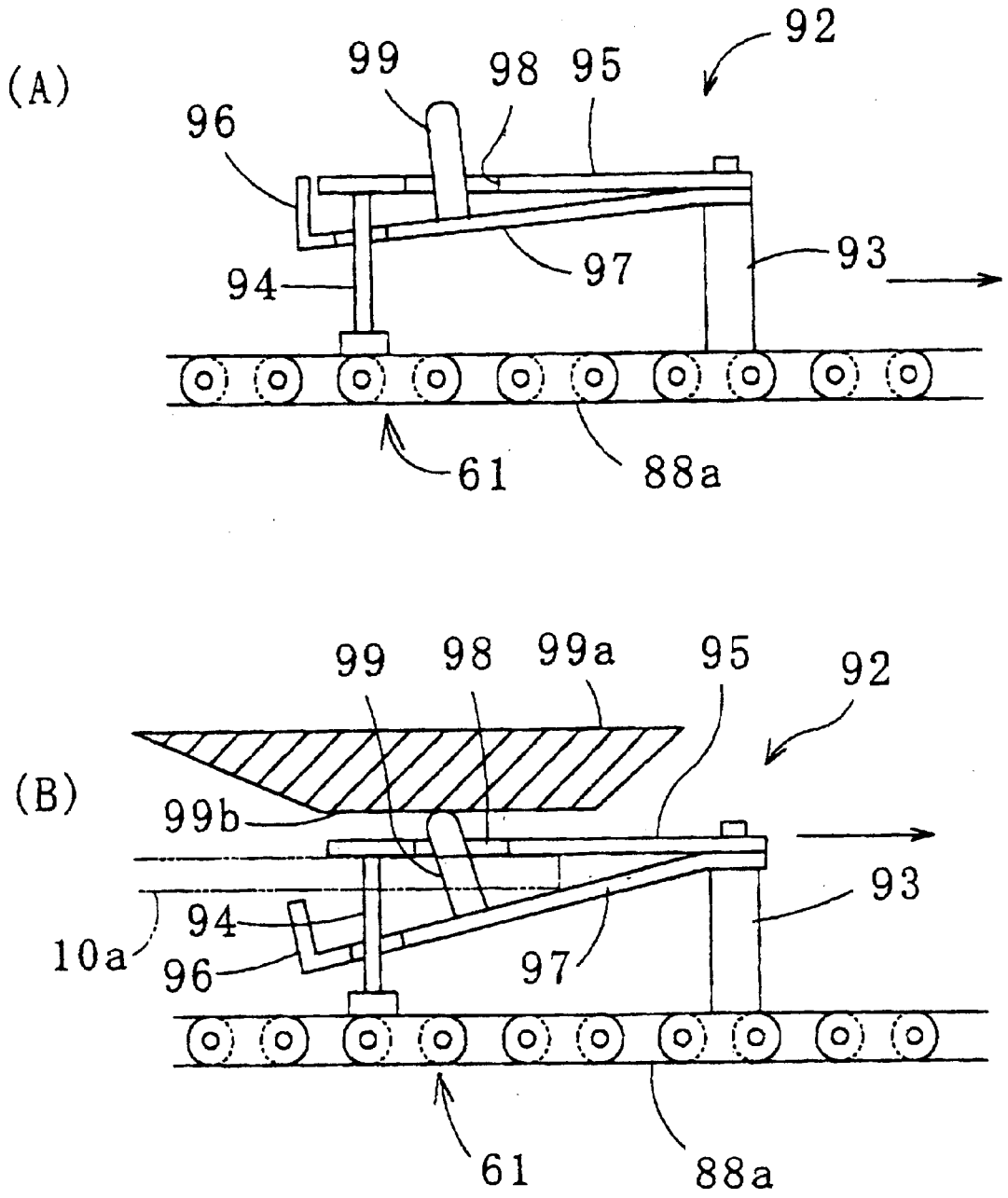
FIGS. 6(A) and 6(B) are side views of the same.

As shown in FIG. 5 and FIG. 6, the gripper 92 comprises an upper stationary plate 95 mounted above a chain conveyor 88*a* constituting the transfer conveyor 61 at parallel intervals by using mount shafts 93 and 94 located before and behind viewed from the side, a lower moving plate 97 having a base (front side) coupled to the lower surface base (front side) of the upper stationary plate 95 and a leaf spring provided on its tip portion (rear side) with a claw 96, and an open-dose operating rod 99 protruding on the upper surface of the lower moving plate 97 and having the upper end extending upward through a long hole 98 formed in the upper stationary plate 95.

With the structure described above, the lower moving plate 97 takes its upper position at normal times by the open-dose operating rod 99 in the free state as illustrated in FIG. 6(A), so that a box board insertion opening is not formed between the rear portion of the upper stationary plate 95 and the rear portion of the lower moving plate 97.

However, when the gripper 61 moves to the position confronting a stopper, which is not shown in the drawings, disposed between the upstream side end of the transfer conveyor 61 and the downstream side of the transfer conveyor 57 by diving the transfer conveyor 61, the open-dose operating rod 99 is urged downward by a lower cam surface 99*b* of a cam plate 99*a* disposed above the upstream side edge portion of the transfer conveyor 61, as shown in FIG. 6(B). With the depressing force to the open-dose operating rod 99, the lower moving plate 97 rotates downward against the urging force of the leaf spring, consequently to form the box board insertion opening between the rear portion of the upper stationary plate 95 and the rear portion of the lower moving plate 97.

Then, by pushing down the stopper, the leading end of the box board 10*a* is inserted into the box board insertion opening. Thereafter, by driving the transfer conveyor 61, the open-close operating rod 99 is made free again, to strongly clamp the leading end of the box board 10*a* by the rear portion of the upper stationary plate 95 and the claw 96 of the lower moving plate 97.

While keeping the box board in the clamping state, the box board 10*a* is reliably transferred to the first creasing station 46, first folding station 47, second creasing station 48, and second folding station 49 in intermittent sequence.

(First Creasing Station)

The first creasing station 46 is defined on the transfer conveyor 61 arranged on the downstream side of the transfer conveyor 57 in series and having the carrying surface on the substantially same level with that of the transfer conveyor 57.

Figure 11:
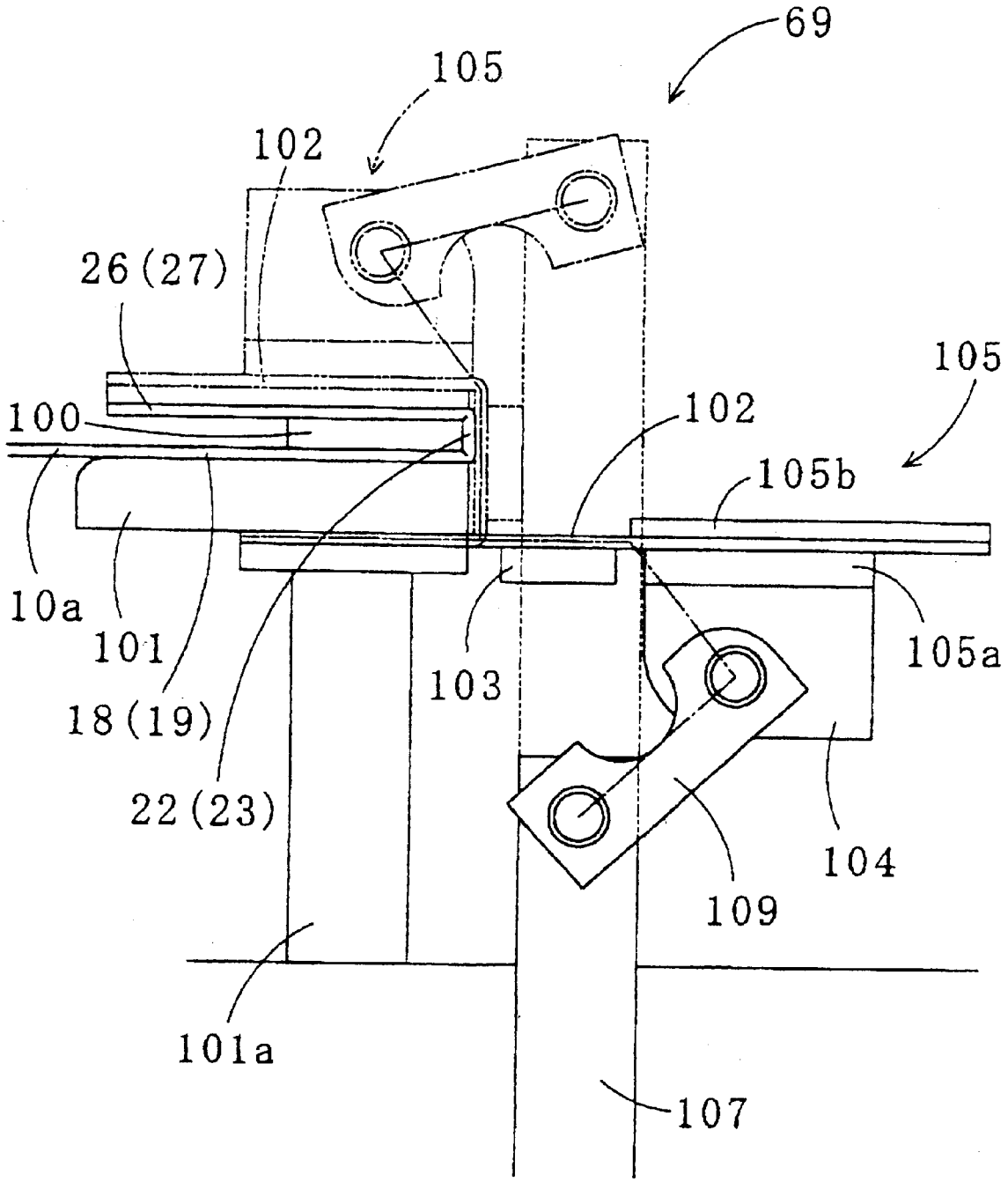
FIG. 11 is an explanatory diagram showing the principal portion of the interfolding mechanism in the paper box assembling device.
Figure 12:
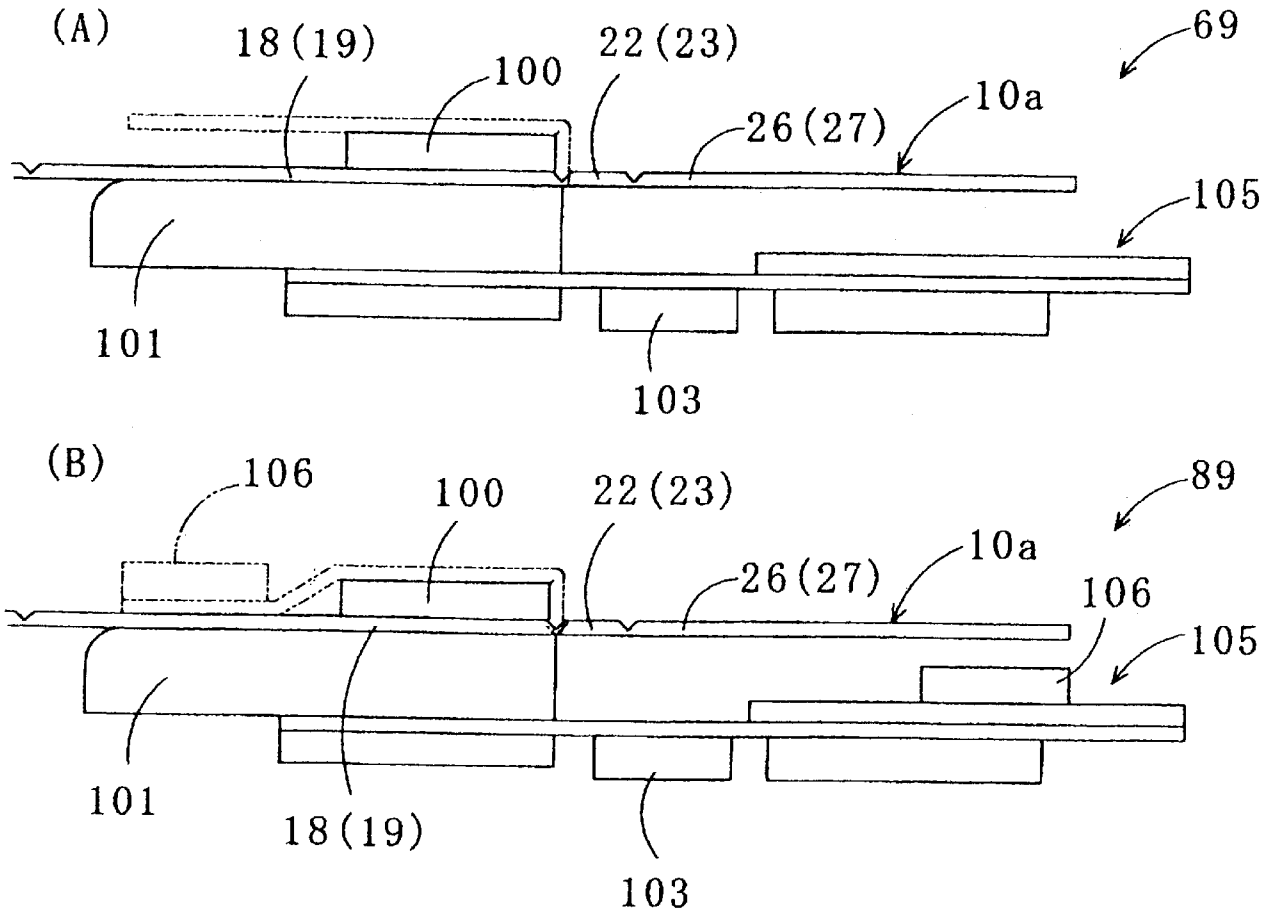
FIGS. 12(A) and 12(B) are an explanatory diagram showing the principal portion of a first creasing device in one embodiment of the paper box assembling device according to the present invention and an explanatory diagram showing the principal portion of the first interfolding mechanism.

As shown in FIG. 11 and FIG. 12(A), the first creasing station 46 comprises the fixed stand 101 for placing the box board 10*a* transferred thereon, interfolding means 105 for folding the inner wall members 26 and 27 inward, which are disposed on both sides of the fixed stand 101 and come into contact with the left and right inner wall members 26 and 27 of the box board 10*a* placed on the fixed stand 101, a first creasing mechanism 69 having a driving source for driving the interfolding means 105, which mechanism is shown as one example of the folding means provided in pairs and, and guide members 100 having longer length than the longitudinal length of the box board 10*a* and supported by the rear side with respect to the forwarding direction of the box board 10*a* with a minute clearance on the fixed stand 101, which minute clearance has its end-to-end distance substantially equal to the distance between the fourth fold lines 22 and 23.

Figure 7:
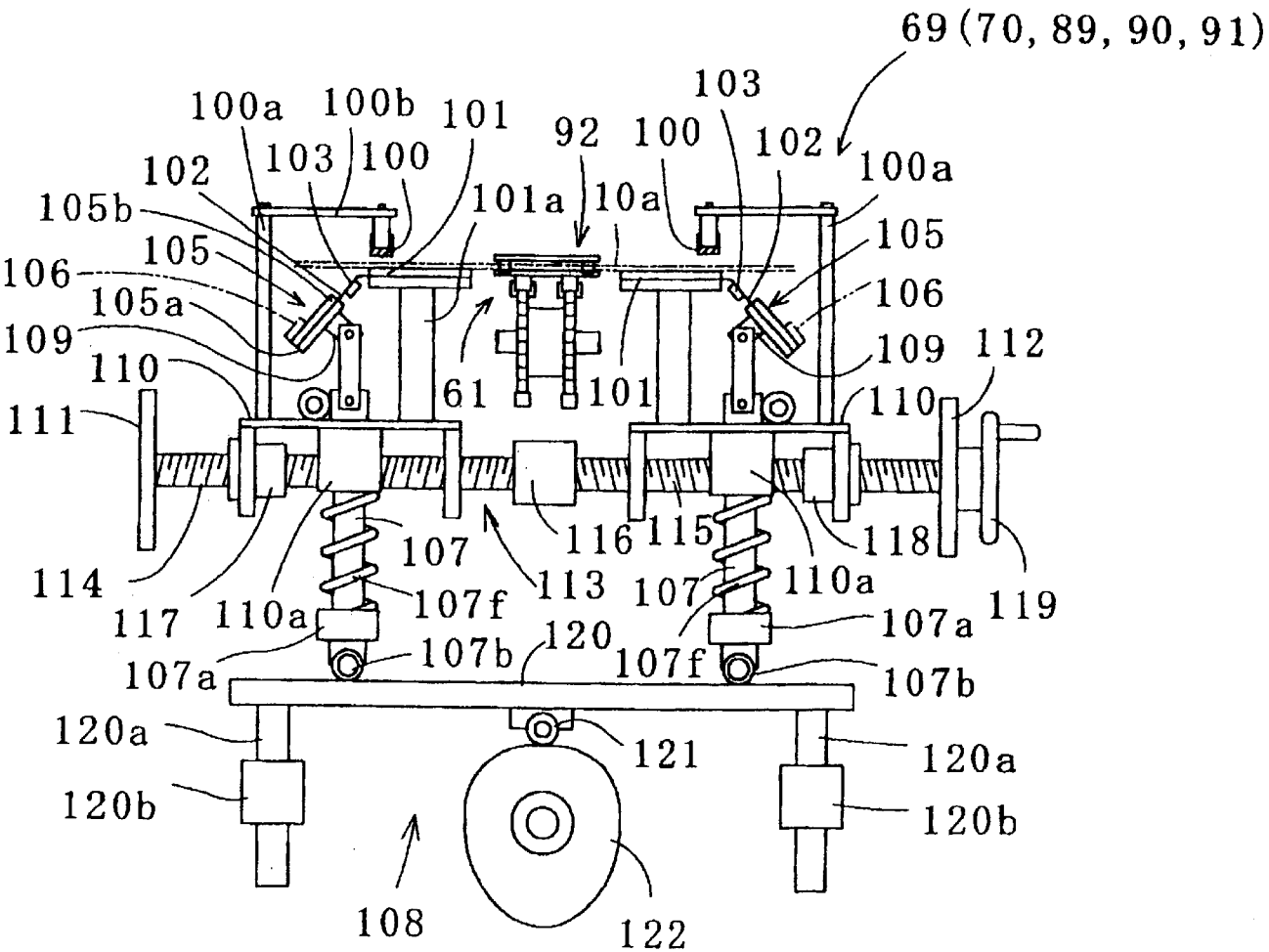
FIG. 7 is a side cross section showing an interfolding mechanism in the paper box assembling device.

The first creasing mechanism 69 includes a flexible sheet 102 made of, for example, cloth (which may be made of vinyl sheet incorporating wires) and having its base secured along the side portions of the fixed stand 101, an outer guide plate 103 disposed at the intermediate portion of the flexible sheet 102 so as to bring the front end thereof into essential contact with the fourth folding lines 22 and 23 of the box board 10*a* through the flexible sheet 102, the interfolding means 105 secured on the front side of the flexible sheet 102 so as to cover the inner wall members 26 and 27 from outside when folding the box board, a lifting rod 107 connected to the interfolding means 105 through a link member 109 and positioned below the fixed stand 101, and a not-shown driving means for driving the lifting rod 107 through a reciprocating lift mechanism 108 (see FIG. 7).

The interfolding means 105 comprises an interfolding plate 105*b* coming in contact with the inner wall members 26 and 27, and a fixed plate 105*a*, so as to hold the flexible sheet 102 tight between the interfolding plate and the fixed plate. The link member 109 and fixed plate 105*a* are coupled through a connecting member 104. Since the component parts are connected to one another through the flexible sheet 102, the rotational center can be shifted to achieve smooth movement in rotation even if the fourth fold lines 22 and 23 are displaced. Incidentally, the flexible sheet 102 may be divided to be used separately for the respective rotating components. By replacing the interfolding means 105 with another one having different thickness, adjustment in folding another box board having different thickness can easily be carried out.

Figure 8:
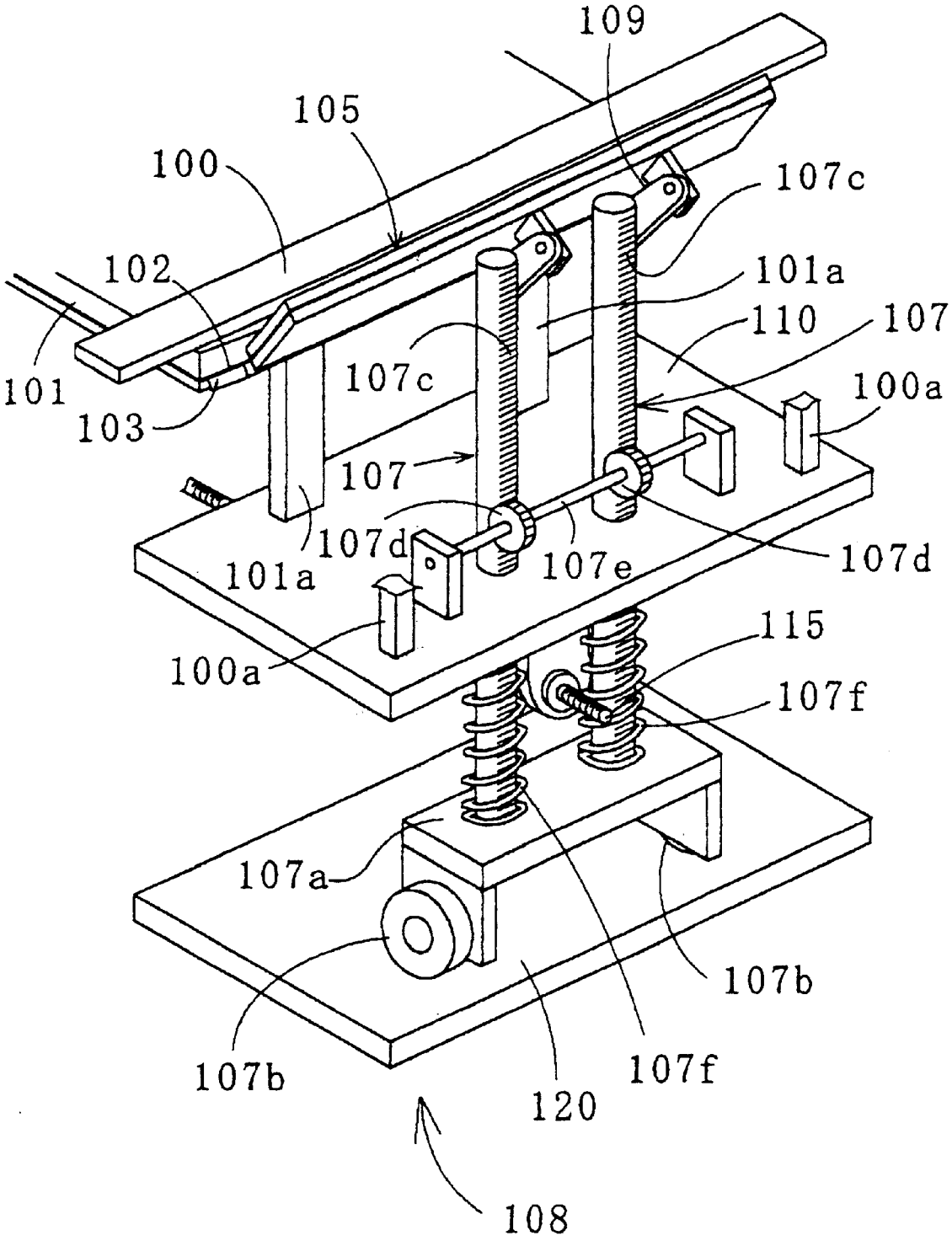
FIG. 8 is a perspective view showing the principal portion of the interfolding mechanism in the paper box assembling device.
Figure 9:
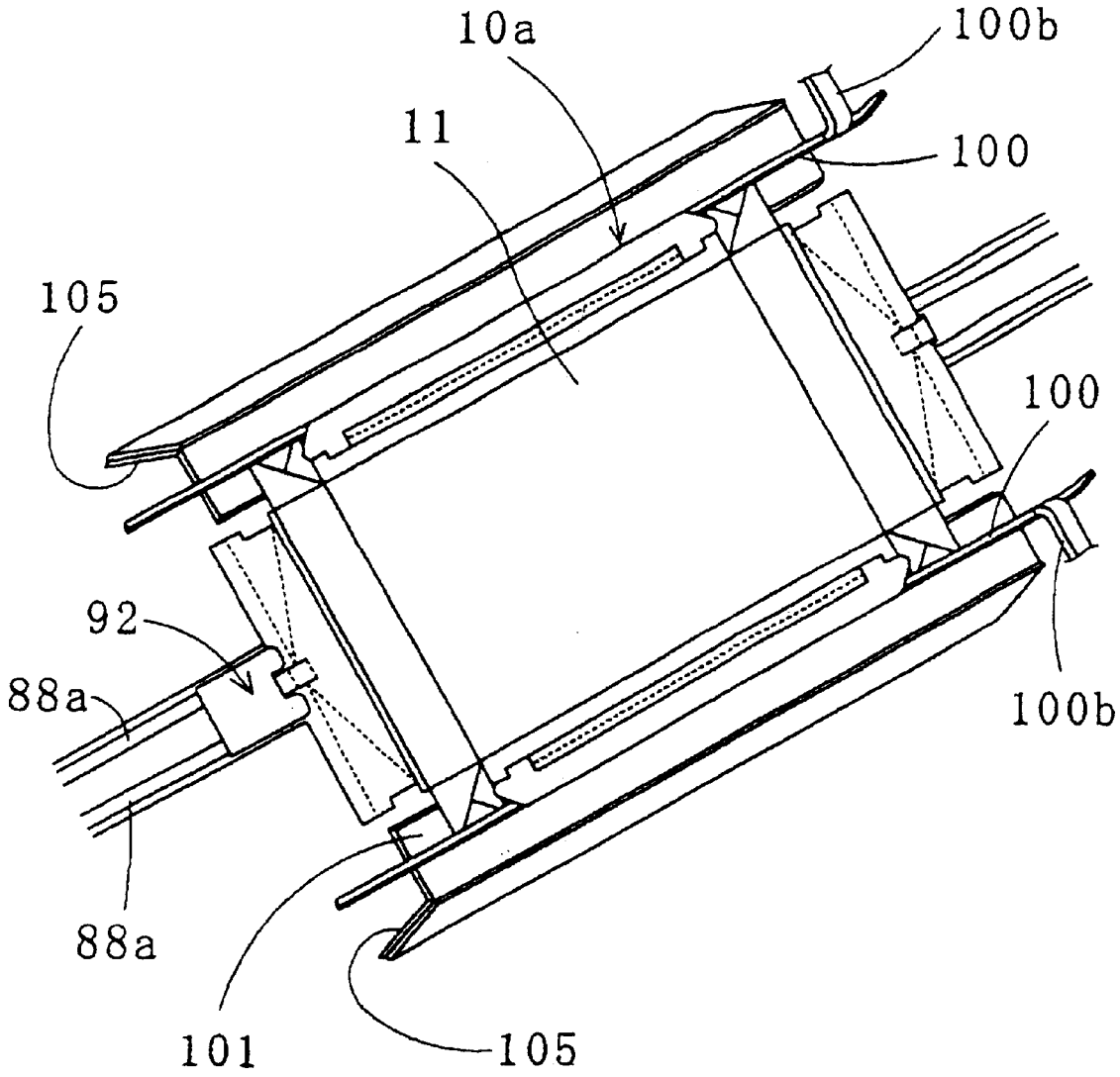
FIG. 9 is a perspective view showing the principal portion of the interfolding mechanism in the paper box assembling device.
Figure 10:
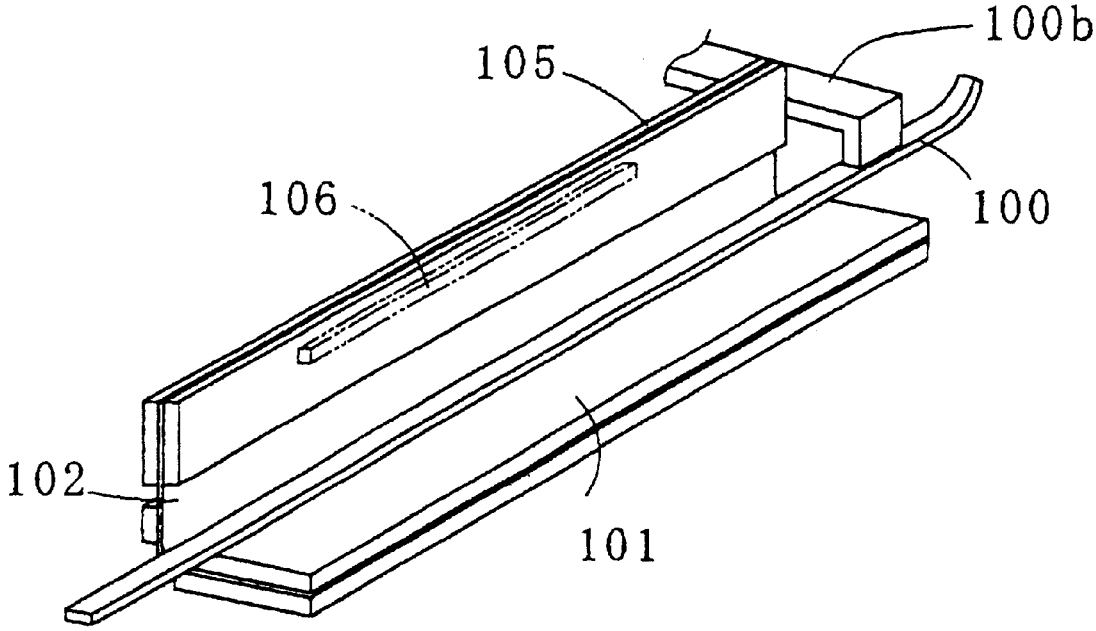
FIG. 10 is a perspective view showing an interfolding means used in the interfolding mechanism in the paper box assembling device.

As shown in FIG. 7 and FIG. 8, the reciprocating lift mechanism 108 serves to not only move up and down the lifting rod 107, but also adjust the width distance between the guide member 100 and the fixed stand 101.

That is, the guide members 100 and the fixed stands 101, which are opposed to each other on the both side portions of the transfer conveyor 61, are disposed on a pair of traversal moving racks 110 arranged symmetrically on the both sides of the transfer conveyor 61. To be more precise, each guide member 100 is mounted on the tip end portion of a guide supporting arm 100*b* extending like a cantilevered beam from the upper end of a guide mounting pillar 100*a* standing on the upper outside of the traversal moving rack 110. Each fixed stand 101 is mounted on the upper portion of the fixed stand mounting pillar 101*a* standing on the upper inside of the traversal moving rack 110.

On the lower portion of the paired traversal moving racks 110, there is disposed rotating shaft 113 supported rotatably by stationary bearing frames 111 and 112. The rotating shaft 113 is formed by coaxially connecting left- and right-hand screw rods 114 and 115 having opposite screwing directions with each other through a joint 116. The left- and right-hand screw rods 114 and 115 are screwed respectively into female screw cylinders 117 and 118 juncturally connected to the lower parts of the traversal moving racks 110. The right-hand screw rod 115 is provided at its end portion with a rotating handle 119.

Each traversal moving rack 110 is provided with a rod guide cylinder 110*a*. Each of the paired lifting rods 107 extends downward through a rod guide hole formed in the rod guide cylinder 110*a* in a slidable state and has the lower end connected to a connecting member 107*a*.

Each of the connecting members 107*a* is provided on its lower surface with a rotating wheel 107*b*. The rotating wheel 107*b* is supported by a rectangular lifting plate 120 in a rotatable state in the width direction. The lifting plate 120 is provided on its lower surface with a rotating roller 121. The rotating roller 121 comes in contact with the peripheral surface of a rotating tangent cam 122. On the peripheral surface of the lifting plate 120, there is mounted a lifting guide shaft 120*a*. The lifting guide shaft 120*a* is fitted in a lifting guide cylinder 120*b* in a slidable state.

In this embodiment, as shown in FIG. 8, each of the lifting rods 107 is provided on its side surface with a rack 107*c*. The rack 107*c* is meshed with a pinion 107*d*. The pinions 107*d* are secured on the both ends of the pinion mounting shaft 107*e* supported rotatably on the traversal moving rack 110.

According to the aforementioned mechanism, when the box board 10*a* is sent to the first creasing mechanism 69 by driving the transfer conveyor 61, the side edge portions of the outer wall members 18 and 19 confronting the both side portions of the transfer conveyor 61 are held between the guide member 100 and the fixed stand 101 while bringing the fourth fold lines 22 and 23 in agreement with the both outer end portions of the guide member 100, as shown in FIG. 7, FIG. 9, FIG. 10, FIG. 11 and FIG. 12(A).

Thereafter, by rotating the tangent cam 122 serving as the reciprocating lift mechanism 108, the lifting plates 120 and lifting rods 107 move upward in the forwarding process, coming in contact with the outer guide plate 103, to allow the outer guide plate 103 to turn over 90 degrees. The lifting rods 107 further move upward to rotate the interfolding means 180 degrees in conjunction with the lifting rods 107 moving upward, thus to allow the inner wall members 26 and 27 of the box board 10*a* corresponding to the both side portions of the transfer conveyor 61 to be rotated toward the inside by 180 degrees relative to the outer end portions of the guide members 100 around the fourth fold lines 22 and 23, and consequently folded inward onto the outer wall members 18 and 19 as shown in FIG. 11.

Since the guide mounting pillars 100*a* for securing the guide members 100 is mounted on the upstream end portions of the guide members 100, the box board 10*a* can be folded away from the guide mounting pillars 100*a* upon passing through the guide members 100 and stopping there. Thus, the guide members 100 can be operated in the stationary state, consequently to make the mechanism of the device simple.

In the returning process of the rotating movement of the tangent cam 122, the lifting plate 120 and lifting rods 107 move downward, to allow the interfolding means 105 to rotate downward 180 degrees and return to its standby position.

In the vertical movement of the guide members as noted above, the lifting rods 107 can move downward smoothly due to return springs 107*f* as shown in FIG. 7 and FIG. 8. In addition, since the lifting rods 107 moves up and down synchronously by means of the meshed racks 107*c* and pinions 107*d*, the smooth vertical movement of the lifting rods 107 can be assured.

As shown in FIG. 7, by turning the rotating handle 119, it is possible to widen or narrow the space between the paired traversal moving racks 110. Likewise, the distance between the guide members 100 located on the side, portion of the transfer conveyor 61 and the fixed stands 101 can be adjusted to easily deal with the box board 10*a* having a different size.

(First Folding Station)

Next, the first folding station 47 will be described. Now, the first foldaway mechanism 89, which is one example of the interfolding mechanism forming a counterpart to the first folding station 47, is equivalent in structure to the first creasing mechanism 69 of the first creasing station 46 except for a press-contact plate 106 as shown in FIG. 12(B). Therefore, the identical components of this embodiment are denoted by like numerical symbols, and thus, the description thereof is omitted below.

On the upper surface of the front end portion of the interfolding means 105, there are mounted the press-contact plates 106, which are illustrated by way of example of elastic plates having elasticity for depressing the front portions of the inner wall members 26 and 27 when folding the box board 10*a*. The left and right press-contact plates 106 are positioned so as to bring pressure on the rear sides of the first adhesive surfaces 26*a* and 27*a* on the front portion of the inner wall members 26 and 27.

With the mechanism described above, when the box board 10*a* is fed to the first folding station 47 by driving the transfer conveyor 61, the left and right peripheral edge portions of the box board 10*a*, i.e. the side edge portions of the outer wall members 18 and 19 corresponding to the both side portions of the transfer conveyor 61, are held between the guide members 100 and the fixed stands 101.

Then, by operating the first interfolding mechanism 89, the lifting rods 107 move upward to rotate the interfolding means 105 180 degrees, consequently to bring the first adhesive surfaces 26*a* and 27*a* formed on the inner surfaces of the left and right inner wall members 26 and 27 into press contact with the first adhesive layers 18*a* and 19*a* formed on the inner surfaces of the left and right outer wall members 18 and 19. As a result, the folded state of the box board can be kept steadily.

(Second Creasing Station)

Figure 13:
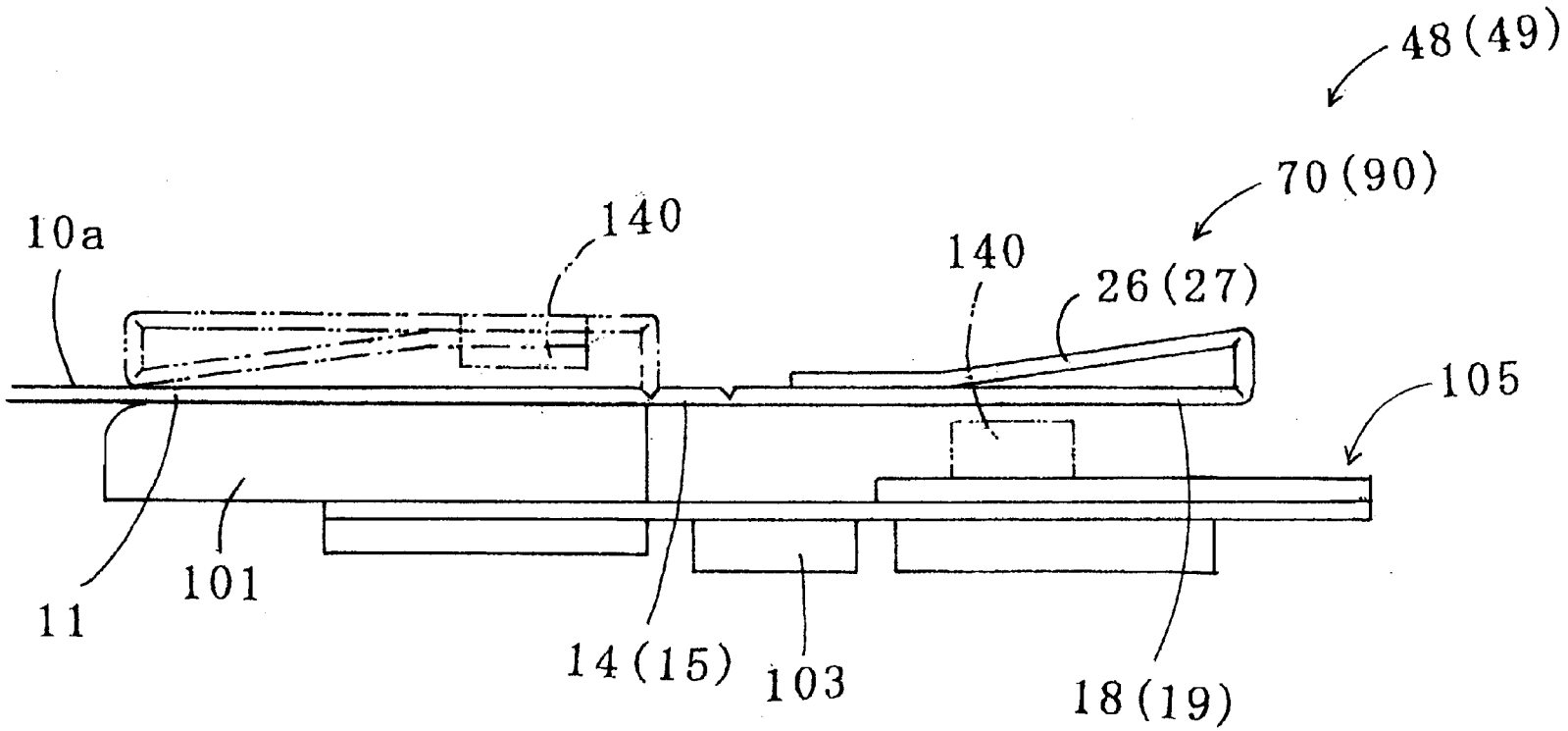
FIG. 13 is an explanatory diagram showing the principal portion of the first interfolding mechanism.

Next, the second creasing station 48 will be described with reference FIG. 7 and FIG. 13. The second creasing mechanism 70, which is one example of the interfolding mechanism of in the second creasing station 48, serves to align the guide members 100 with the insides of the second fold lines 14 and 15 of the box board 10*a* by narrowing the distance between the paired traversal moving racks 110 by rotating the rotating handle 119 of the first creasing mechanism 69. The second creasing mechanism is similar in structure to the first creasing mechanism 69, and therefore, the identical components of this embodiment are denoted by like numerical symbols, and thus, the description thereof is omitted below.

When the box board 10*a* is sent to the second creasing station 48 by operating the transfer conveyor 61, the both peripheral edge portions of the box board 10*a*, i.e. the both end portions of the box bottom panel 11 confronting the both side portions of the transfer conveyor 61, are held between the guide member 100 and the fixed stand 101.

By operating the second creasing mechanism 70, the lifting rods 107 move upward to allow the creasing the interfolding means 105 to rotate 180 degrees, consequently to fold back the outer wall members 18 and 19 along with the inner wall members 26 and 27. As a result, the second fold lines 14 and 15 are definitely formed so as to be folded easily.

(Second Folding Station)

Next, the second folding station 49 will be described with reference to FIG. 7 and FIG. 13. A second foldaway mechanism 90 which is a counterpart of the second folding station 49 is provided with press-contact plates 140 (shown by a chain double-dashed line) in place of the guide member 100. Other components in the second foldaway mechanism are identical with those in the second folding station, and thus, the description of the identical components is omitted below.

The interfolding means 105 is provided on its upper surface with the elastic press-contact plates 140 designed to align with the both end portions of the box board 10*a*. The two press-contact plates 140 are mounted for each of the second adhesive layers 36–39 of the box board 10*a* so as to be pressed from the rear sides thereof.

When feeding the box board 10*a* to the second folding station 49 by driving the transfer conveyor 61, the both end portions of the box board 11*a* confronting the both side portions of the transfer conveyor 61 are set on the fixe stations 101.

Then, by operating the second foldaway mechanism 90 to move the lifting rods 101 upward, the interfolding means 105 rotates 180 degrees to fold back the outer wall members 18 and 19 together with the inner wall members 26 and 27 along the second fold lines 14 and 15, consequently to be folded up onto the left and right peripheral edge portions of the box bottom panel 11. Concurrently, the side-panel connecting members 32–35 are folded inward along the connecting fold lines 65–68, sticking the second adhesive layers 36–39 onto the second adhesive surfaces 16*a*, 16*b*, 17*a* and 17*b*.

Although a guide means for aligning the side-panel connecting members with the second adhesive surfaces 16*a*, 16*b*, 17*a* and 17*b* is not provided on the second foldaway mechanism 90, the side-panel connecting members can be assuredly folded due to the definite fold lines formed by the creasing mechanism. Furthermore, since the transfer conveyor 61 is provided with the gripper 92, displacement of the box board 10*a* in the width direction can be prevented to exactly determine the folding positions.

(Second Cut-Out Station)

As shown in FIG. 3, change-direction rollers 128 are disposed on the terminal side portions of the transfer conveyor 61 on the downstream side of the second folding station 49 and arranged in the direction orthogonal to the transferring direction of the transfer conveyor 61. On the side portion opposite to the position at which the change-direction rollers 128 of the transfer conveyor 61, there are disposed a pressure plate 130 for pressing the box board 10*a* toward the change-direction rollers 128, and an air cylinder, which is not shown in the drawing, for moving the pressure plate 130 backward. Besides, on the terminal side portion of the transfer conveyor 61, there is disposed a cam plate 99*a* for releasing the box board 10*a* from the gripper 92.

When one of the box boards 10*a*, which are intermittently fed at regular intervals, arrives at the terminal point 62 of the transfer conveyor 61, the box board 10*a* caught by the gripper 92 is free from the gripper by the action of the cam plate 99*a*. Subsequently, the pressure plate 130 operates to push the box board 10*a* toward the change-direction rollers 128. Thus, the box board 10*a* changes its traveling direction without rotating and moves in the direction of the change-direction rollers 128.

The second transfer conveyor 64 for intermittently sending the box board 10*a* is disposed behind the change-direction rollers 128 and has a lower carrying surface. On the upstream side of the second transfer conveyor 64, the second cut-out station 43 is placed. On the second transfer conveyor 64, there are arranged grippers 92 at the predetermined intervals.

The second cut-out station 43 includes a storage unit 63 for storing the box boards 10*a*, a plurality of holding plates for holding the box board 10*a*, embracing the periphery of the storage unit 63, and a not-shown feeding device disposed on the upper portion of the storage unit 63 so as to feed the box boards 10*a* one by one to the downstream of the second transfer conveyor 64 while holding the box board 10*a* by using a sucking force.

In the storage unit 63, the box boards 10*a* processed by the second folding station 49 are stored. The box boards 10*a* are sucked out from the upper portion of the storage unit 63 one by one and fed to the downstream side of the second transfer conveyor 64.

Incidentally, the second cut-out station 43 may be identical in structure with the first cut-out station 40.

According to the mechanism described above, when the device falls into difficulties in such a state that the box board 10*a* is applied with adhesive to cause one of the first and second transfer conveyors 61*a* and 64 to stop operation, the other first and second transfer conveyors 61*a* and 64 are continuously operated to applying adhesive to the box boards 10*a* which are not yet coated with the adhesive by using the second cut-out station 43 with the storage unit 63. As a result, occurrence of defective box board can be diminished.

(Second Adhesive Applying Station)

The second adhesive applying station 44 is identical in structure with the first adhesive applying station 41 except for the direction of transferring the box board 10*a*, the location of the spot nozzles, and the portion to which the adhesive is applied. Therefore, the identical components of this embodiment are denoted by like numerical symbols, and thus, the description thereof is omitted below.

Spot nozzles, which are not-shown in the drawing, in the second adhesive applying station 44 disposed on the both sides with respect to the width direction are mounted on the upper portion of the box board 10*a*, on which the third adhesive layers 24*a* and 25*a* are formed.

When one of the box board 10*a* intermittently fed arrives at the second adhesive applying station 44, hot melt adhesive is sprayed from the spot nozzles to form the third adhesive layers 24*a* and 25*a* thereon.

(Third Folding Station)

Next, the third folding station 45 will be described with reference to FIG. 7.

Now, a third folding mechanism 91 shown as one example of the folding mechanism which is a counterpart of the Gird folding station 45 serves to widen the space between the paired traversal moving racks 110 by turning the rotating handle 119 and align the guide members 100 with the insides of the third fold lines 20 and 21 of the box board 10*a*. The third folding mechanism further comprises a press-contact plate which is not shown. The components other than these noted here are identical with those of the first folding mechanism 89, and therefore, the description thereof is omitted below.

On the upper surface of the interfolding means 105, the press-contact plates 106 are mounted. The left and right press-contact plates 106 is so arranged that the third adhesive layers 24*a* and 25*a* of the box board 10*a* can be pressed from the rear side thereof.

When the box board 10*a* is fed to the third folding station 45 by driving the second transfer conveyor 64, the outer wall members 16 and 17 confronting the both side portions of the second transfer conveyor 64 are held between the guide members 100 and the fixed stands 101.

Then, by operating the third folding mechanism 91, the lifting rods 107 move upward to allow the interfolding means 105 to rotate 180 degrees and the inner wall members 24 and 25 to be folded up onto the outer wall members 16 and 17. Thereafter, the third adhesive layers 24*a* and 25*a* formed on the inner wall members 24 and 25 are pressed against the third adhesive surfaces 16*c* and 17*c*, to accomplish the desired adhesion.

The third fold lines 20 and 21 are sufficient long, so that the box board can be surely folded with adhering operation without being previously creased to form definite fold lines. However, in a case of dealing with a box board of large size, a creasing device for folding the box board beforehand to form definite fold lines may be disposed.

Figure 14:
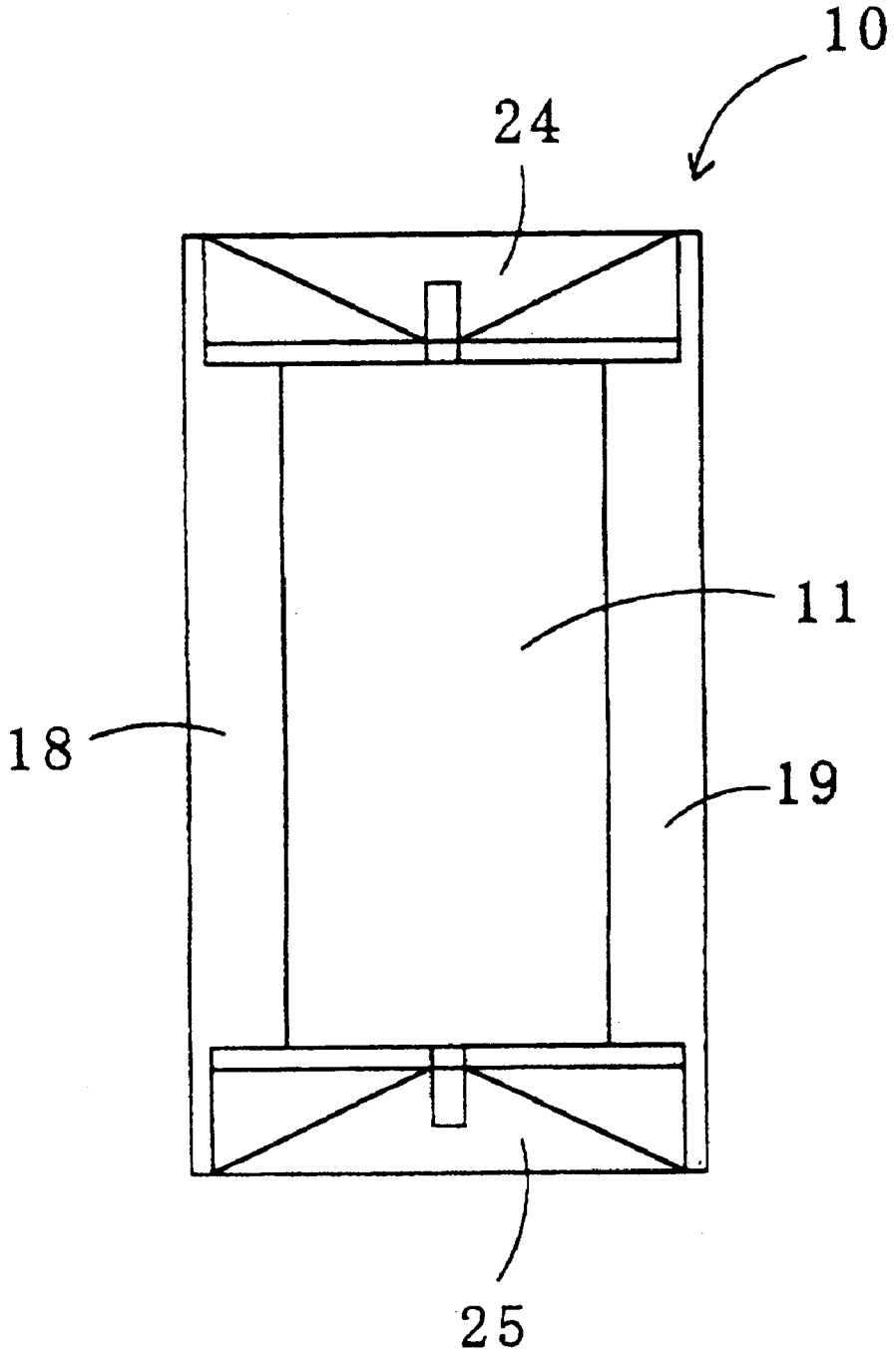
FIG. 14 is a perspective view showing a first order assembled state of the pullout paper box to which the paper box assembling device of the invention is applied.

The mechanism noted above makes it possible to produce a primary assembled pullout paper box 10 (formed like a flat plate) as shown in FIG. 14.

The pullout paper box 10 thus produced is sent to the not-shown baling station to be packed and then shipped.

Next, the assembling method for producing the pullout paper box by use of the first embodiment of the paper box assembling device A according to the present invention will be described.

The box boards 10*a* with the inner wall members 24 facing the forward are stacked in the box board stacker 50 in the first cut-out station 40. By diving the cut-out conveyor 52, the box boards 10*a* stacked in the box board stacker 50 are sent out from under the front end holding plate 54 one by one and forwarded toward the first adhesive applying station 41 by the supply rollers 58.

The box board 10*a* sent to the first adhesive applying station 41 placed on the upstream side of the first creasing station 46 is coated in part with hot melt adhesive sprayed from the spot nozzles 59 to form the first adhesive layers 18*a* and 19*a* thereon.

Subsequently, the box board 10*a* moving to the downstream side by means of the transfer conveyor 57 and upper rollers 60 is transferred over the transfer conveyor 61 in the state held by the grippers 92 passing through beneath the cam plate 99*a* mounted on the end portion on the upstream side of the transfer conveyor 61.

The assembling method for producing the pullout paper box comprises the following processes.

(First Process)

The box board 10*a* having the unfolded inner wall members 26 and 27 is fed into the space between the fixed stands 101 and the guide members 100, having the fourth fold lines 22 and 23 aligned with the both outer end portions of the guide members 100 at the first creasing station 46.

(Second Process)

By driving the interfolding means 105 disposed on the both sides of the fixed stands 101, the inner wall members 26 and 27 are folded inward with reference to the outer end portions of the guide members 100 in contact with the fourth fold lines 22 and 23.

(Third Process)

The box board 10*a* with the folded inner wall members 26 and 27 is drawn out from the first creasing station 46, having the front side thereof with respect to the forwarding direction held by the grippers 92.

At the first folding station 47, the adhesive surfaces 26*a* and 27*a* and the first adhesive layers 18*a* and 19*a* are formed on the box board 10*a* in the substantially same manner as the aforementioned first to third processes. Then, at the second creasing station 48 and the third folding station 45, the outer wall members 18 and 19 are folded inward along the second fold lines 14 and 15, thus to be stuck to the second adhesive layers 36–39 and the second adhesive surfaces 16*a*, 16*b*, 17*a* and 17*b*.

Thereafter, the box board is stacked in the storage unit 63 of the second cut-out station 43 placed on the upper end portion of the second transfer conveyor 64 orthogonal to the transfer conveyor 61 by the pressure plate 130 at the terminal position 62 of the transfer conveyor 61. On the box boards 10*a* stacked in the storage unit 63, which are sent out one by one, the third adhesive layers 24*a* and 25*a* are formed at the second adhesive applying station 44. At the third folding station 45, the inner wall members 24 and 25 are folded inward along the third fold lines 20 and 21, and the third adhesive layers 24*a* and 25*a* and the third adhesive surfaces 16*c* and 17*c* are formed on the box board.

Thus, the primary assembled pullout paper box 10 (formed like a flat plate) shown in FIG. 14 can be produced in such a manner as described above. The pullout paper box 10 thus produced is sent to the not-shown baling station to be packed and then shipped.

Although the invention has been described in its preferred form, it is understood that the present disclosure of the preferred form has been changed in the details of construction and the combination and arrangement of parts may be resorted to without departing from the spirit and the scope of the invention as hereinafter claimed. For example, the first to fourth fold lines 12–15 and 20–23 are each formed of double fold lines, but may be formed of a single fold line. In such a case, the guide members 100 may be increased in thickness.

Also, the first adhesive applying station 41 is located on the upstream side of the first creasing station 46 in the aforementioned embodiment, but it may be located between the creasing station 46 and the first folding station 47.

Further, another adhesive applying station may be disposed between the second creasing station 48 and the second folding station 49. According to these structures noted above, it is possible to shorten the time required for applying the adhesive to the box board and sticking the adhesive layers and increase the adhering strength.

INDUSTRIAL APPLICABILITY

As is apparent from the foregoing description, according to the assembling method for producing the paper box of the present invention, since the side wall members are folded inward with respect to the outer side portions of the guide members, they can be steadily folded along the fold lines. Thus, a large number of paper box can be dealt with in a short period of time.

Furthermore, since the guide members can be used in their stationary state, it is possible to decrease a number of moving component parts and diminish occurrence of mechanical troubles during operation.

Specifically, by tuning the interfolding means by using the flexible sheet, the axis of rotation of the wall member can be shifted in accordance with displacement of the fold lines of the box board to be folded, consequently to lessen the burden on the device.

The assembling device for producing the paper box according to the present invention can effectually fold the both end portions of the box board inwardly along the fold lines and bring the folded parts into press contact with each other. Thus, when sticking the folded parts to each other, adhesion strength resultantly obtained can be increased.

Moreover, since the assembling device of the invention adopts the double fold lines along which the wall members are folded up, the thickness of the guide members can be adjusted to produce a posh paper box having the fleshy side walls by surely folding the wall members of the box board along the fold lines.

Also, the assembling device for producing the paper box according to the present invention has the first to third folding stations, so that assembly of the paper box can be automated.

Especially, by disposing the first and second adhesive applying stations on the respective upstream side of the first and third folding stations, applying of adhesive and folding of the portions applied with the adhesive can be consecutively performed, thus to prevent the adhesion force of the adhesive applied to the box board from weakening on the way to the succeeding process.

Since the assembling device of the invention is provided with the first transfer conveyor and the second transfer conveyor arranged orthogonal to the first transfer conveyor to turn over the paper box 90 degrees, the box board can be folded at the third folding station in the same direction as that in which the box board is folded at the first and second folding stations. Accordingly, the device of the invention makes it possible to use the processing mechanisms having the same structure. Besides, applying of adhesive onto the box board and folding of the portions of the box board applied with the adhesive in the longitudinal and transverse directions can be continuously carried out.

What is claimed is:

1. A device for assembling a box having both side wall members unfolded and connected to a box bottom panel through parallel fold lines, comprising:

a folding station for placing the unfolded box thereon, said folding station being provided with fixed stands for allowing said box thereon and a pair of guide members formed on fixed stands with a minute clearance and supported directing forwardly so as to have both outer side end portions between which a distance substantially equal to a distance between said both side wall members is defined, and an interfolding mechanism having an interfolding means mounted rotatable from the outside to the upper inside thereof around the outer side end portions of said guide members, said interfolding mechanism including a flexible sheet having basal portion fixed along the side end portions of said fixed stands, and having said interfoldirig means secured on the front side of said flexible and being arranged so as to operate said guide members by moving vertically lifting rods connected to said interfolding means through a link member.

2. A device for assembling a paper box set forth in claim 1, wherein said interfolding mechanism comprises a flexible sheet having basal portion fixed along the side end portions of said fixed stands, an outer guide plate disposed on the intermediate part of said flexible sheet and having the front end essentially abutting on said fold lines of said paper box at the time of folding said paper box, said interfolding means secured on said front part of said flexible sheet so as to cover said side wall members at the time of folding, a lifting rod connected to said interfolding means through a link member and disposed below said fixed stands, and a drive means for driving said lifting rod.

3. A device for assembling a paper box set forth in claim 1 or claim 2, wherein an elastic plate for pressing the front side of said interfolding means at the time of folding said paper box is provided on the front side of said interfolding means.

4. A device for assembling a box set forth in claim 1 or claim 2, wherein the thickness of said guide member is adjustable.

5. A device for assembling a box having front, rear, left and right outer wall members connected to a square box bottom panel through pairs of first and second parallel fold lines, front, rear, left and right inner wall members connected to a square box bottom panel through pairs of third and fourth parallel fold lines, and side-panel connecting members connected to the respective side end portions of the adjoining outer wall members and provided on their intermediate portions with diagonal inward fold lines, comprising:

a first folding station for allowing said left and right inner wall members to be folded back inwardly along said fourth fold line and adhered to said left and right outer wall members through a first adhesive layer formed beforehand, a second folding station for allowing said left and right outer wall members to be folded back inwardly along said second fold line, folded up so as to overlap left and right peripheral edge portions of said box bottom panel and allowing said side-panel connecting members formed at the four corners thereof to be fold back inwardly along connecting fold lines extending from said second fold line and adhered to the left and right peripheral edge portions of said front and rear outer wall members corresponding to said side-panel connecting members formed at the four corners through a second adhesive layer formed beforehand, a third folding station for allowing said front and rear inner wall members to be folded inwardly along said third fold line and adhered to said front and rear outer wall members through said third adhesive layer formed beforehand, said first to third folding stations being each provided with fixed stands for allowing said box to be placed thereon and a pair of interfolding mechanisms having interfolding means for folding said outer or inner wall members inwardly, said interfolding means being disposed on both sides of said fixed stands to fold inward said outer wall members or inner wall members of said box placed on said fixed stands, while being in contact with said outer wall members or inner wall members, and a driving source for driving said interfolding means, and a flexible sheet having its base secured along the side portions of said fixed stands, said interfolding means being secured on the front side of said flexible sheet and being arranged so as to operate guide members by moving vertically lifting rods connected to said interfolding means through a link member, said first and third folding stations each having a pair of said guide members each being longer than the longitudinal length of said box, said guide member being supported directing forwardly at the rear side in relation to the forwarding direction of said box with a minute clearance formed on said fixed stands, said minute clearance having both outer side end portions between which a distance substantially equal to a distance between said fold lines.

6. A device for assembling a paper box set forth in claim 5, further comprising a first adhesive applying station for forming said first and second adhesive layers, said first adhesive applying station being placed on the upstream side of said first folding station, and a second adhesive applying station for forming said third adhesive layer, said second adhesive applying station being placed on the upstream side of said third folding station, said first adhesive layer being formed on a part of the inside of each of said left and right outer wall members, said second adhesive layers being formed on the forward-facing end portion of the front piece of the side-panel connecting members disposed at the four corners and the backward-facing end portion of the rear piece of the side-panel connecting members, said third adhesive layer being formed on the outer sides of the front and rear inner wall members or the inner sides of the front and rear inner wall members.

7. A device for assembling a paper box set forth in claim 6, wherein said first adhesive applying station, first folding station and second folding station are located on a first transfer conveyor, and said second adhesive applying station and third folding station are located on a second transfer conveyor arranged orthogonal to the first transfer conveyor for tuning said paper box 90 degrees.

* * * * *